US007607734B2

(12) United States Patent
Clapper et al.

(10) Patent No.: US 7,607,734 B2
(45) Date of Patent: Oct. 27, 2009

(54) CHILD MOTION DEVICE

(75) Inventors: Joshua E. Clapper, Exeter, PA (US); William B. Bellows, Wyomissing, PA (US); Matthew J. Ransil, Richland, PA (US); James E. Godiska, Exton, PA (US); David Saint, Elverson, PA (US); Nate Saint, legal representative, Mortantown, PA (US)

(73) Assignee: Graco Children's Products Inc., Atlanta, GA (US)

( * ) Notice: Subject to any disclaimer, the term of this patent is extended or adjusted under 35 U.S.C. 154(b) by 0 days.

(21) Appl. No.: 11/556,553

(22) Filed: Nov. 3, 2006
(Under 37 CFR 1.47)

(65) Prior Publication Data

US 2007/0262627 A1 Nov. 15, 2007

Related U.S. Application Data

(60) Provisional application No. 60/732,640, filed on Nov. 3, 2005.

(51) Int. Cl.
*A47D 13/10* (2006.01)
*A63G 9/16* (2006.01)
*A47C 3/02* (2006.01)

(52) U.S. Cl. ..... 297/273; 297/260.2; 297/274; 297/276; 297/280; 297/281; 297/282; 472/120

(58) Field of Classification Search ..... 297/260.2, 297/273, 274, 276, 280, 281, 282
See application file for complete search history.

(56) References Cited

U.S. PATENT DOCUMENTS 43,972 A 8/1864 Coldwell
100,083 A 2/1870 Stephan
616,697 A 12/1898 Cowles et al.
1,360,495 A * 11/1920 Bugenhagen ..... 472/120
1,707,167 A * 3/1929 Marshall ..... 472/120
1,731,658 A * 10/1929 Gnuechtel ..... 472/120
1,874,345 A 8/1932 Parrott
2,371,384 A 3/1945 Dyer et al.

(Continued)

FOREIGN PATENT DOCUMENTS

DE 2421474 11/1975

(Continued)

OTHER PUBLICATIONS

Fisher-Price Nature's Touch Baby Papasan Cradle Swing, Product # G2609, 2006; 2 pages; www.fisher-price.com.

(Continued)

*Primary Examiner*—Rodney B White
(74) *Attorney, Agent, or Firm*—Lempia Braidwood LLC

(57) ABSTRACT

A child motion device has a frame configured to rest on a floor surface. The device also has a drive system that drives an adjustable motion assembly. The adjustable motion assembly can include an adjustable arm that is connected between a seat holder and the frame at one of a plurality of positions. The connection position of the adjustable arm can adjust at least one motion characteristic of the device. The adjustable motion characteristics can include a gliding motion and a swinging motion.

20 Claims, 8 Drawing Sheets

U.S. PATENT DOCUMENTS

| | | | | | |
|---|---|---|---|---|---|
| 2,506,890 | A | | 5/1950 | Pratt | |
| 2,510,223 | A | * | 6/1950 | Hart | 472/120 |
| 2,616,485 | A | * | 11/1952 | Robbins | 472/125 |
| 2,704,111 | A | | 3/1955 | Wunderlich | |
| 3,147,972 | A | | 9/1964 | Borsuk | |
| 3,391,932 | A | | 7/1968 | Scalf | |
| 3,829,086 | A | * | 8/1974 | Lelong | 472/125 |
| 4,155,548 | A | | 5/1979 | Smith et al. | |
| 4,226,467 | A | | 10/1980 | Boudreau | |
| 4,258,446 | A | | 3/1981 | McAllister et al. | |
| 4,620,334 | A | | 11/1986 | Robinson | |
| 4,805,902 | A | | 2/1989 | Casagrande | |
| 4,911,429 | A | * | 3/1990 | Ogbu | 297/273 X |
| 4,911,499 | A | | 3/1990 | Meeker | |
| 5,303,433 | A | | 4/1994 | Jang | |
| 5,403,239 | A | | 4/1995 | Zimmers | |
| 5,451,093 | A | * | 9/1995 | Petrie et al. | 297/282 X |
| 5,688,211 | A | | 11/1997 | Myers | |
| 5,707,294 | A | * | 1/1998 | Fischer | 297/281 X |
| 5,803,817 | A | | 9/1998 | Stern | |
| 5,833,545 | A | * | 11/1998 | Pinch et al. | 297/273 X |
| 6,027,409 | A | | 2/2000 | Favorito et al. | |
| 6,254,490 | B1 | * | 7/2001 | Lawson et al. | 297/273 X |
| 6,318,803 | B1 | * | 11/2001 | Garland | 297/281 X |
| 6,343,994 | B1 | | 2/2002 | Clarke | |
| 6,574,806 | B1 | | 6/2003 | Maher | |
| 6,811,217 | B2 | | 11/2004 | Kane et al. | |
| 6,854,799 | B1 | | 2/2005 | Asbach et al. | |
| 6,932,709 | B1 | * | 8/2005 | Gubitosi et al. | 297/274 X |
| 2002/0113469 | A1 | | 8/2002 | Stern et al. | |
| 2005/0101219 | A1 | | 5/2005 | Paesang et al. | |
| 2006/0012230 | A1 | | 1/2006 | Kennedy | |
| 2007/0040431 | A1 | * | 2/2007 | Bapst et al. | 297/274 |

FOREIGN PATENT DOCUMENTS

| | | | | | |
|---|---|---|---|---|---|
| DE | 3834934 | A1 | * | 4/1990 | 297/273 |
| GB | 1 163 624 | | | 9/1969 | |
| GB | 2 312 374 | | | 10/1997 | |
| JP | 48068367 | | | 9/1973 | |
| JP | 60014819 | | | 1/1985 | |
| WO | WO 03/079861 | | | 10/2003 | |
| WO | WO 2006/096712 | | | 9/2006 | |

OTHER PUBLICATIONS

English language translation of JP 48-68367.
English language translation of DE 2421474.

* cited by examiner

CHILD MOTION DEVICE

RELATED APPLICATION DATA

This patent claims priority benefit of U.S. Provisional Patent Application Ser. No. 60/732,640, which was filed on Nov. 3, 2005, and the contents of which are incorporated herein by reference.

BACKGROUND

The present disclosure is generally directed to child motion devices, and more particularly to a device for supporting a child and imparting a non-traditional swinging, bouncing, swaying, gliding, or other motion to the child.

Child motion devices such as conventional pendulum swings and bouncers are known in the art. These types of devices are often used to entertain and, sometimes more importantly, to sooth or calm a child. A child is typically placed in a seat of the device and then the device is used to swing the child in a reciprocating pendulum motion. In the case of a bouncer, a child is placed in the seat and vertical oscillating movement of the child results from the child's own movement or external force applied to the seat by someone else such as a parent.

Research has shown that many babies or children are not soothed or calmed down by these types of motion, but that these same children may be more readily calmed or soothed by motion imparted by a parent or adult holding the child. Parents often hold their children in their arms and in front of their torso and move in a manner that is calming and/or soothing to the child. Such movements can include side-to-side rocking, light bouncing up and down, or light rotational swinging as the parent either swings their arms back and forth, rotates their torso from side-to-side, or moves in a manner combining these motions.

Many types of child motion devices are known that are not readily and compactly foldable for storage or stowing away. Additionally, currently known child motion devices do not typically enable multiple different optional seating positions and arrangements for the child or optional motion characteristics. A typical child motion device has only a single seating orientation and a single motion characteristic that can be provided for a child placed in the seat. A number of these types of devices are motorized to impart automatic and continuous movement to the child seat. These devices typically mount the motor above the head of a child within the device. The motor can be a noisy nuisance for the child. Additionally, the drive takes up space above the seat, which can make it difficult for an adult to position a child in the device.

Other alternative motion devices are known as well. For example, U.S. Pat. No. 6,811,217 discloses a child seating device that can function as a rocker and has curved bottom rails so that the device can simulate a rocking chair. U.S. Pat. No. 4,911,499 discloses a motor driven rocker with a base and a seat that can be attached to the base. The base incorporates a drive system that can move the seat in a rocking chair-type motion. U.S. Pat. No. 4,805,902 discloses a complex apparatus in a pendulum-type swing. Its seat moves in a manner such that a component of its travel path includes a side-to-side arcuate path in a somewhat horizontal plane (see FIG. 9 of the patent). U.S. Pat. No. 6,343,994 discloses another child swing wherein the base is formed having a first stationary part and a second part that can be turned or rotated by a parent within the first part. The seat swings in a conventional pendulum-like manner about a horizontal axis and a parent can rotate the device within the stationary base part to change the view of the child seated in the seat.

SUMMARY

In accordance with one aspect of the present invention, a child motion device includes a frame supported by a support surface. The device includes an adjustable motion assembly supported by the frame at a location spaced from the support surface. A child seat holder is supported by the adjustable motion assembly. The adjustable motion assembly has a motion characteristic capable of imparting a gliding component and a swinging component to the child seat holder. The child seat holder travels along a travel path having the motion characteristic.

It should be appreciated that the foregoing and other aspects of the invention will appear from the following description. In the description, reference is made to the accompanying drawings which form a part thereof, and in which there is shown by way of illustration, and not limitation, preferred embodiments of the invention. Such embodiments do not necessarily represent the full scope of the invention, and reference must therefore be made to the claims herein for interpreting the full scope of the invention.

BRIEF DESCRIPTION OF THE DRAWINGS

Objects, features, and advantages of the present invention will become apparent upon reading the following description in conjunction with the drawing figures in which like reference numerals are intended to represent like elements throughout, and in which.

DETAILED DESCRIPTION

A number of examples are disclosed herein of alternative motion devices for soothing, calming, and/or entertaining children. The disclosed child motion devices solve or improve upon one or more of the problems or difficulties noted above with respect to known motion devices. The disclosed alternative motion devices each generally include a frame assembly that supports an adjustable motion assembly which, in turn, supports a child seat holder. The seat holder is configured to move a child seat or other child carrying or supporting device through a travel path that lies in a plane that can be perpendicular to a reference plane defined by a floor surface or tilted or angled slightly relative to the reference plane. The travel path can have at least two motion components. The first component is a gliding component in which the seat holder tends to maintain its orientation relative to a reference plane as it travels reciprocally along its travel path. The second component is a swinging component in which the seat holder tends to change its orientation relative to the reference plane as it travels reciprocally along its travel path. In the disclosed examples, the adjustable motion assembly is driven by a drive system that reciprocally moves the seat holder through its travel path.

In one example, the seat holder is configured to accept and support a child seat or other child carrying or supporting device above the ground surface. In one example, the child seat holder that cooperates with the child seat to permit setting the child seat on the alternative motion device in more than one optional seat orientation. In this way, a child seated in the seat can experience a variety of different motions. In another example, the seat holder can be specifically configured to accept and support a seat or other child carrying device from another product, such as a car seat.

The terms generally, substantially, and the like as applied herein with respect to vertical or horizontal orientations of various components are intended to mean that the components have a primarily vertical or horizontal orientation, but need not be precisely vertical or horizontal in orientation. The components can be angled to vertical or horizontal, but not to a degree where they are more than 45 degrees away from the reference mentioned. In many instances, the terms "generally" and "substantially" are intended to permit some permissible offset, or even to imply some intended offset, from the reference to which these types of modifiers are applied herein.

Figure 1:
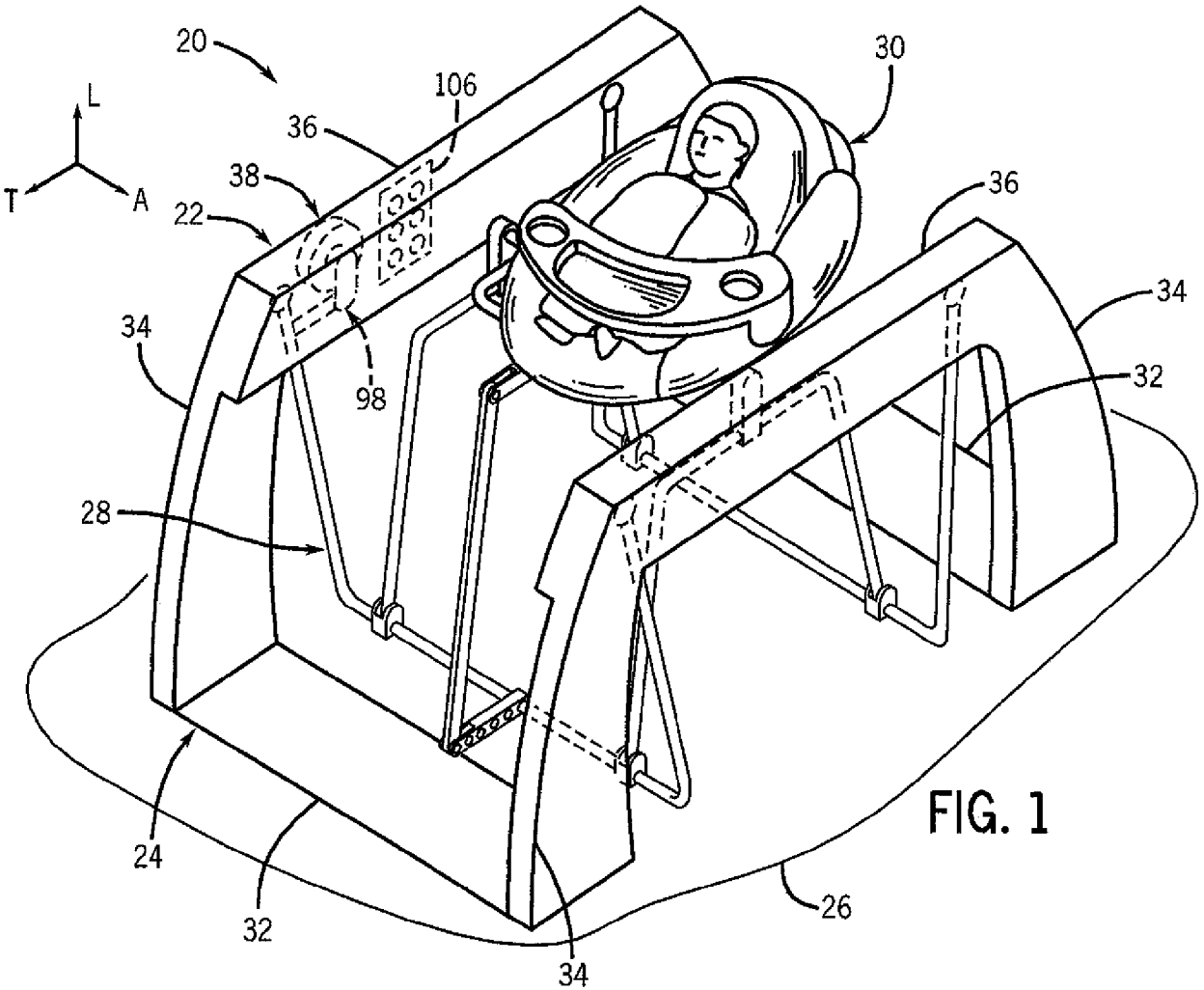
FIG. 1 is a perspective view of a child motion device including a frame that supports an adjustable motion assembly that drives a seat assembly constructed in accordance with the teachings of the present invention.

Turning now to the drawings, FIG. 1 shows one example of a child motion device 20 constructed in accordance with the teachings of the present invention. The device 20 in this example generally includes a frame that has a base section 24 configured to rest on a horizontal floor surface 26. The base section 24 of the child motion device 20 shown in FIG. 1 can assume a pair of laterally extending parallel beams, bars, tubes, rails or other support members 32 that define the footprint of the device 20. It should be appreciated that the base section 24 has been illustrated only as an exemplary embodiment, and that the base section 24 can assume any one of a virtually infinite number of configurations suitable to adequately support the remainder of the child motion device 20 on the floor surface 26. Alternatively, the base section 24 can be replaced by any alternative support member that can rest on a floor surface 26 as illustrated or be cantilevered from any suitable support structure.

A frame 22 further includes a pair of longitudinal posts 34 that respectively extend generally upward from the laterally outer ends of each of the support members 32. A pair of transverse support members 36 are connected between the upper ends of the posts 34. The frame 22 supports an adjustable motion assembly 28 which, in turn, movably supports a child seat assembly 30 for movement along a travel path defined by at least two components. The first component is a gliding component whereby the child seat assembly 30 tends to maintain its orientation relative to a reference plane during travel. The second component is a swinging component whereby the child seat assembly 30 tends to change its orientation relative to the reference plane during travel. The proportion of swinging and gliding motion components that contribute to the overall movement of the child seat assembly 30 can be adjustable. The motion assembly 28 depends from the transverse support members 36 and is driven by a drive system 38 that is further supported by one of the support members 36.

Throughout this detail description, the terms "floor surface" and "reference plane" are utilized to define both a surface on which the device 20 rests and a reference for comparison to other aspects and parts of the invention for ease of description. However, the invention is not intended to be limited to use with only a specifically horizontal orientation of either the base section 24 or the reference plane. Instead, the floor surface 26 and the reference plane are utilized to assist in describing relationships between the various components of the device 20, it being appreciated that the device 20 could, for instance, instead be supported by a surface that defines an angle with respect to the horizontal, for instance a vertical wall.

For the purposes of this description, the device 20 defines three orthogonal directional components. A longitudinal component (Arrow L in FIG. 1) defines a vertical direction, or a direction perpendicular to the reference plane 26 as illustrated. A transverse component (arrow T in FIG. 1) extends perpendicular to the longitudinal component, and defines a fore-aft direction. A lateral component (Arrow A in FIG. 1) extends perpendicular to both the longitudinal and transverse components, and defines a side-to-side direction.

Figure 2:
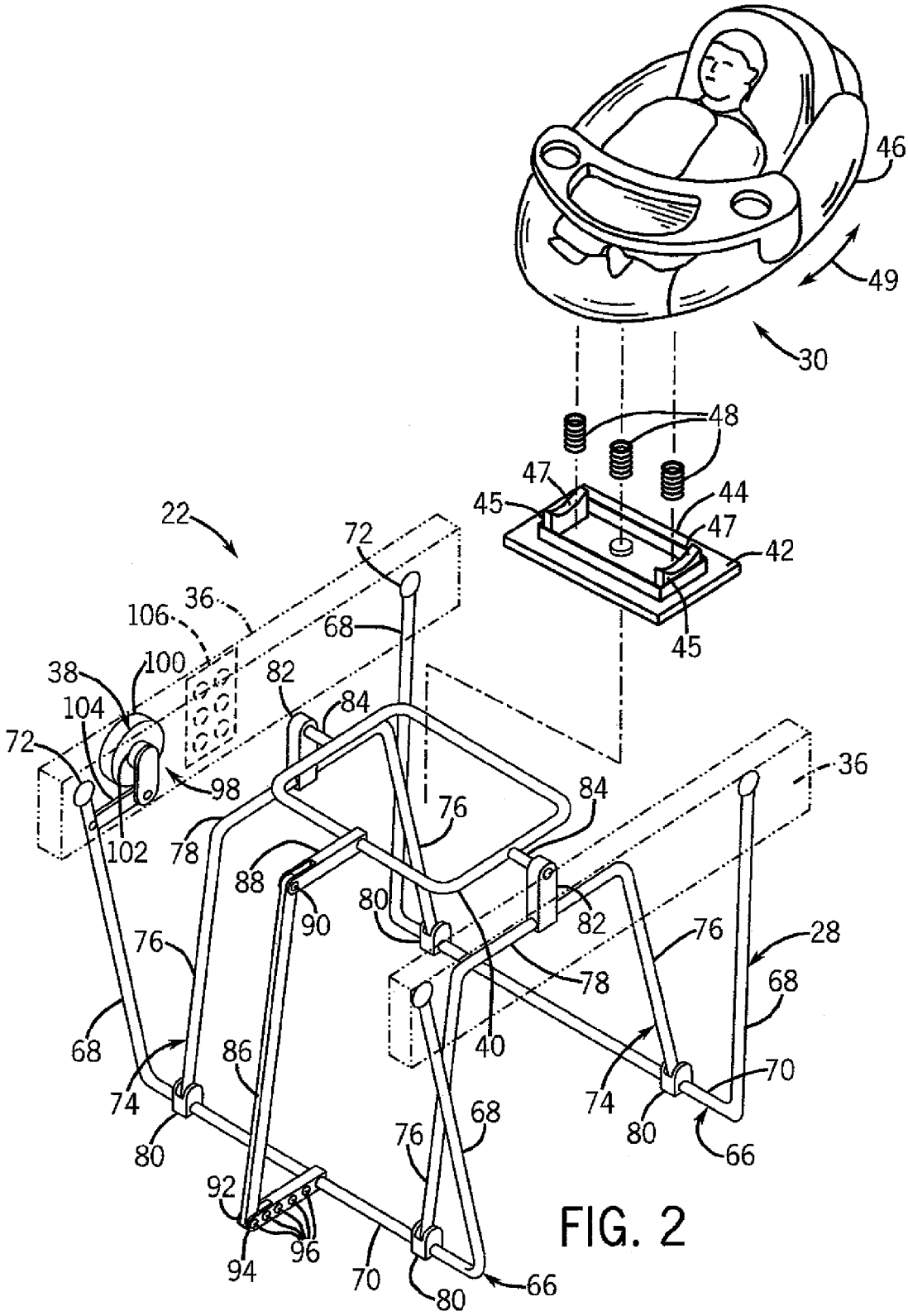
FIG. 2 is an exploded perspective view of the frame illustrated in FIG. 1.

FIG. 2 shows the frame 22 with the support members 32 and posts 34 removed to more clearly illustrate the other components of the child motion device 20. Referring now also to FIG. 2, the seat assembly 30 includes a seat holder 40 that provides a motion transmission device between the frame 22 and a supported child seat 46. The seat holder 40 can be integrated into the frame 22, the child seat 46, or can be a member separate from but operably connected to the frame 22 and the child seat 46. While the seat holder 40 is enumerated and described herein, it should be appreciated that other structure forming part of the device 20 can also serve as a seat holder as broadly defined herein.

The seat holder 40 as illustrated is supported by the adjustable motion assembly 28, and supports a base plate 42 and a swivel plate 44 rotatably supported on the upper surface of the base plate 42. The swivel plate 44 supports a pair of spaced supports 45 that define curved upper surfaces 47 that are configured to receive the bottom surface of the child seat 46 such that the child seat is nested within the upper surfaces 47. As configured, the child seat 46 can recline fore and aft about a horizontal axis extending perpendicularly between the spaced supports, as indicated by Arrow 49. Alternatively, or additionally, the seat back can recline relative to the seating surface. The child seat 46 is mounted onto the swivel plate 44 such that the seat can rotate about the vertical axis to any desired orientation. One or more springs 48, which can be traditional coil springs or any alternative structure having a desired spring constant, can be connected between the swivel plate 44 and the child seat 46 such that the child seat can travel vertically (or bounce) during operation of the device 20. Alternatively, the swivel plate 44 could be eliminated and the springs 48 can extend between the base plate 42, or other support structure, and the child seat 46. Alternatively still, the child seat 46 can be connected to the swivel plate 44 without an interposed spring member.

Figure 3:
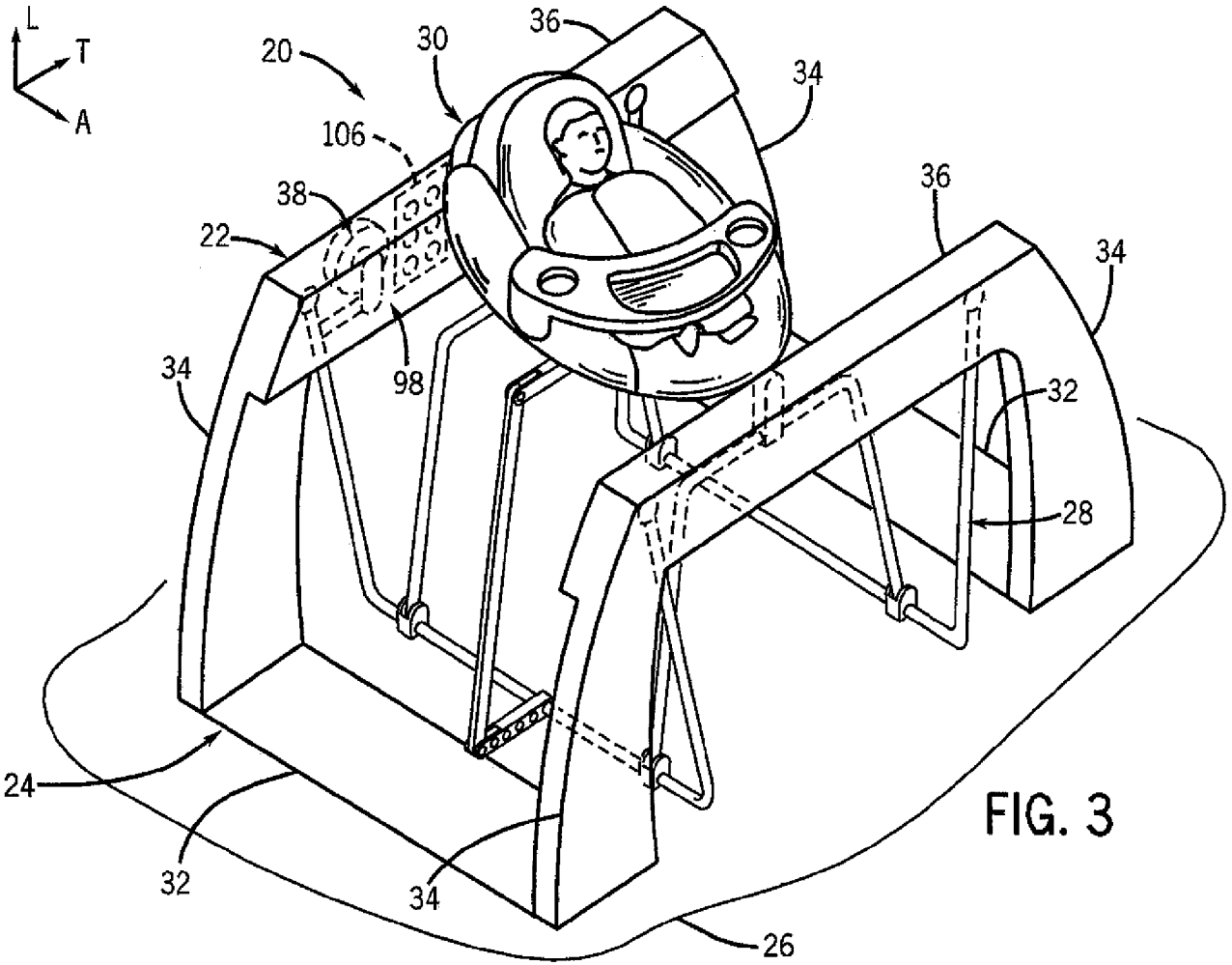
FIG. 3 is a perspective view of a child motion device similar to that illustrated in FIG. 1 showing the seat assembly having a child seat oriented in accordance with an alternate embodiment of the present invention.

Accordingly, as illustrated in FIG. 1, the child seat 46 can be orientated to face the direction of seat travel during operation of the device 20 (i.e., the child faces a direction substantially parallel to the direction of seat travel such that the child travels substantially forward and backward). Alternatively, as illustrated in FIG. 3, the child seat 46 can be oriented to face a direction substantially perpendicular to the direction of seat travel during operation of the device (i.e., the child faces a direction substantially perpendicular to the direction of seat travel such that the child travels substantially from side-to-side). Alternatively still, the child seat 46 can swivel about the swivel plate 44 to any desirable position between the positions illustrated in FIGS. 2 and 3. By placing the seat 46 in different orientations on the child motion device 20, the child seated therein can experience different relative motions and a variety of different visual environments. The seat assembly 30 can further include any suitable latch mechanism (not shown) to at least temporarily lock the child seat 46 in its desired orientation and prevent unintentional rotation of the seat 46 during operation of the device 20.

Figure 4:
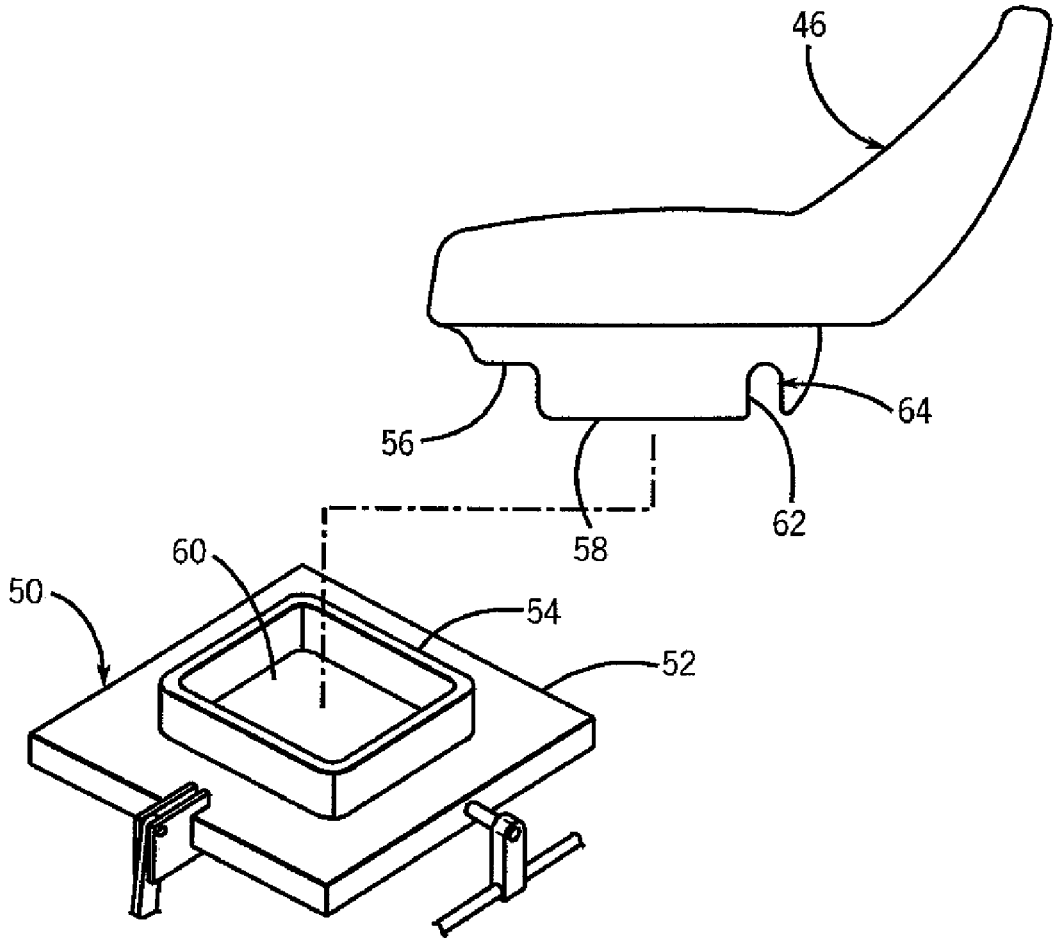
FIG. 4 is an exploded perspective view illustrating a seat assembly constructed in accordance with an alternative embodiment.

It should be appreciated that the seat assembly 30 is just one example of numerous alternative embodiments that can either support the 46 seat such that the orientation of the seat 46 is adjustable or rigid, and that, unless otherwise noted, the present invention is not limited to the illustrated embodiment. One alternative embodiment is illustrated in FIG. 4, in which a seat holder 50 includes a plate 52 that can be supported by the adjustable motion assembly 28 in the same or similar manner as illustrated and described below with respect to the seat holder 40. A square or rectangular shaped frame 54 can extend up from the plate 52. The bottom of the child seat 46 can have a flat region 56 on one end that rests on one linear side segment of the frame 54.

A depending region 58 of the seat base is sized to fit within an opening 60 of the frame 54. The other end of the base has one or more aligned notches 62 that are configured to receive the opposite linear side segment of the frame 54. The depending region 58 and the notches 62 hold the child seat 46 in place on the frame 54. Gravity alone can be relied upon to retain the seat 46 in position, though in another example, one or more positive manual or automatic latches 64 can be employed in part of the seat, at one or both ends of the seat, as part of the frame 54, and/or at one or both ends of the seat frame 54, to securely hold the child seat 46 in place on the frame 54. The latches 64 can be spring biased to automatically engage when the seat is placed on the frame 54. It should thus be appreciated that the seat 46 can be mounted onto the frame 54 in any one of an array of orientations rotatably offset 90° relative to the plate 52, including the two orientations illustrated in FIGS. 1 and 3.

Referring again to FIG. 2, as described above, the seat assembly 30, and in particular the seat holder 40, is supported by the adjustable motion assembly 28. The adjustable motion assembly 28 includes a pair of laterally extending swing arms 66 that are spaced transversely from each other. Each swing arm 66 includes a pair of laterally spaced vertical uprights 68, each pivotally connected at its upper end to the laterally inner surface of the corresponding support member 36 at joints 72. In the illustrated embodiment, each swing arm 66 is connected to the opposing transverse ends of the support members 36. Each swing arm 66 further includes a lateral crossbar 70 integrally connected between the lower ends of the uprights 68.

A pair of inverted U-bars 74 is connected between the opposing swing arms 66. Specifically, each U-bar 74 includes a pair of laterally spaced vertical risers 76 that are rotatably connected to the crossbar 70 of the swing arms 66. Specifically, the lower ends of the risers 76 are received in a corresponding plurality of brackets 80 that, in turn are mounted onto the opposing lateral ends of the crossbars 70. Each U-bar includes a transverse linkage 78 that is integrally connected between the upper ends of the risers 76.

The seat holder 40 is supported in the frame 22 by a bracket 82 that extends up from the u-bar 74. Specifically, the bracket 82 is connected to substantially the middle of the transverse linkage 78. A finger 84 is rotatably held within the bracket 82, and extends inwardly and is connected to the substantially the middle of the transverse surface of the seat holder 40. Accordingly, the seat holder 40 can pivot about a substantially lateral axis defined by the fingers 84.

An adjustable arm 86 extends between the front end of the seat holder 40 and the front upright 66, and at least partially defines the angular orientation of the seat holder 40 (and therefore the child seat 46) relative to the reference plane 26. Specifically, the proximal end of a coupler 88 extends forward from the front forward lateral edge of the seat holder 40 at a location substantially at the midpoint of the edge. A joint 90 pivotally connects the distal end of the coupler 88 to the upper end of the adjustable arm 86 such that the arm 86 can rotate about a lateral axis extending through the distal end of the coupler 88. The lower end of the adjustable arm 86 is connected to a multi-positional bracket 92 via a joint which can comprise a pin 94 that can be locked in any one of a series of connection locations in the form of spaced apertures 96 extending laterally through the bracket 92. The pin 94 further extends through the distal end of the adjustable arm 86 such that the adjustable arm can pivot about a lateral axis defined by the selected aperture 96. The pin 94 can have a removable locking feature well known in the art to prevent the accidental removal of the pin 94 during operation.

A drive assembly 98 is configured to drive and oscillate at least one of the uprights 68, and therefore the corresponding upright swing arm 66 about the upper end of the driven upright. The drive assembly 98 includes a motor 100 that has a driven output shaft 102 connected to a bell crank 104. The bell crank 104 is connected at one end to the output shaft, and at its opposing end to the upper end of the upright 68. Accordingly, as the output shaft 102 rotates in a given direction, the bell crank 104 biases the upright 68 in a driven direction, thus causing the driven swing arm 66 to pivot about the upper ends of the uprights 68. Because the swing arms 66 are connected via the inverted U-bars 74, the driven swing arm 66 also causes the opposing, or passive, swing arm 66 to pivot about the upper ends of its uprights 68.

The drive assembly 98 can include features that can be manipulated by a user to adjust the amount of angular travel of the driven swing arm 66 relative to the frame 22, the speed of the movement, and the like. An operator panel, touch pad device, a remote control unit, or user interface can be provided on the frame, for instance on the support member 36 at a location adjacent the motor 100 with buttons, a touch screen, a keypad, switches, combinations of these features, or the like that a user can manipulate to access, operate, adjust, and alter various performance characteristics of the device 20. FIGS. 1-3 show one example of a touch pad or screen 106 carried on the frame 22.

In one example, a user interface with a "cap-touch" or capacitive feedback circuit can be employed. The interface senses a change in capacitance near an electronic part of the device, which can be programmed to trigger a signal to an integrated circuit. The capacitance change signal can be design to trigger based on human contact or contact with a metal object that closely approaches the interface or an electronic board. Many advantages could be achieved by this type of user interface. First, the threshold change level can be designed to be child-proof, i.e., to prohibit a child from altering the product settings or operational mode. Also, the same electronics can be utilized within a motion feedback loop. A metal projection or finger can be coupled to any moving part of the seat and can be positioned to move relative to the electronic board as the support arm moves. The electronics can then track or monitor the arm motion through the relative capacitance changes. This feature could be used for product cycle and motion parameter purposes to control the device.

The present invention recognizes that the various components of the adjustable motion assembly 22 define a geometric configuration that determines the path followed by the child seat assembly 30 during operation of the device 20. As will now be described, the motion assembly 22 can be configured to provide a path that includes at least two motion components. The first component is a gliding component in which the seat holder 40 tends to maintain its orientation relative to a reference plane as it travels reciprocally along its travel path. The second component is a swinging component in which the seat holder 40 tends to change its orientation relative to the reference plane as it travels reciprocally along its travel path. As the child seat 46 is supported by the seat holder 40, the child seat also travels along a path that can be defined by the two motion components.

In accordance with one aspect of the present invention, the motor 100 can drive the swing arm 66 in one direction only (e.g., clockwise rotation about its proximal end 72) and then allow gravity to drive the swing arm 40 counterclockwise through the neutral position to a predetermined angle during the second part of the cycle 102 (shown by phantom lines 102) until the counterclockwise inertia is overcome by gravitational forces, which then cause the swing arm 40 to return to its neutral position thereby completing a full cycle, at which time the motor 82 again drives the swing arm 40 to rotate clockwise. Alternatively, the motor 82 can drive the swing arm 40 counterclockwise only, or alternatively still can drive the swing arm in both the clockwise and counterclockwise directions through the entire oscillation. The angle of the partial orbit or arc segment of the swing arms 66 about their upper joints 72 can be less than 150 degrees, and preferably less than 90 degrees (i.e., 45 degrees on either side from the neutral position).

Figure 5:
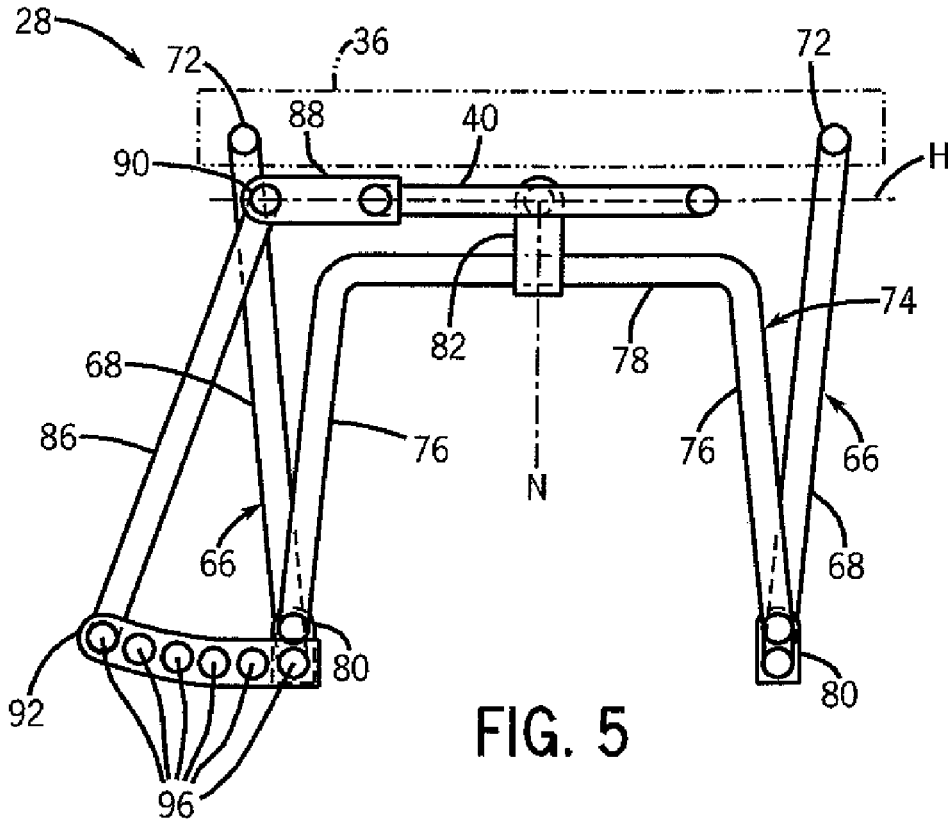
FIG. 5 is a partial side elevation view of the child motion device illustrated in FIG. 1 including the adjustable motion assembly configured to impart a motion having a swinging component in accordance with one aspect of the present invention.
Figure 6:
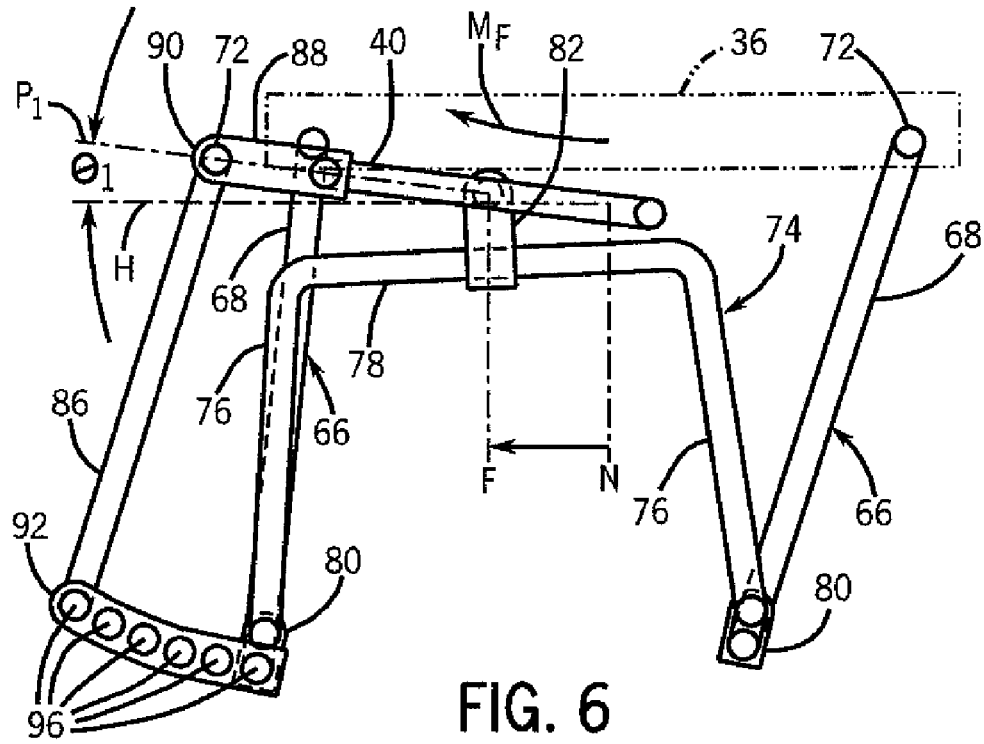
FIG. 6 is a partial side elevation view of the adjustable motion assembly illustrated in FIG. 5 showing the motion in a first direction.

Referring now to FIG. 5, the child motion device 20 is illustrated in a first configuration whereby the lower end of the adjustable arm 86 is connected to the forward most connector 96. In this configuration, the seat holder 40 can be oriented along a horizontal plane H parallel to the reference plane 26 when the adjustable motion assembly maintains the seat holder 40 in the neutral position N. As illustrated in FIG. 6, as the drive assembly 98 propels the driven swing arm 66 about, for instance, the clockwise direction about joint 72, the U-bars 74 cause the opposing swing arm 66 to pivot about its joints 72 as well. As the U-bars 74 travel along with the swing arms 66, they cause the seat holder 40 to translate in the forward direction of Arrow $M_F$ to a forward position F. However, the lower end of the adjustable arm 86 is disposed in a selected connection 96 on the bracket 92 which is driven to travel in the clockwise direction along with the swing arm 66.

Because the selected connection 96 is located at the front of the bracket 92, the bracket 92 experiences upward vertical travel as the swing arm 66 pivots. Accordingly, the adjustable arm 86 drives the front end of the seat holder 40 vertically upward as well, thus producing an angle $\theta_1$ between the seat holder 40 and the horizontal plane. Once the drive assembly 98 has driven the seat holder 40 to a desired forward position F, the adjustable motion assembly 28 causes the swing arms 66 to rotate counterclockwise about their upper joints 72 causing the seat holder to translate rearwardly along the direction of Arrow $M_R$. As the driven swing arm 66 causes the rear end of the bracket 92 to translate vertically upward during counterclockwise rotation, the adjustable arm 86 biases the front end of the seat holder 40 downwardly substantially the same amount that the arm 85 biased the seat holder 40 upwardly during forward motion. Accordingly, and angle $\theta_2$ defined by the rear end of the seat holder 40 and the horizontal is substantially equal to $\theta_1$ assuming that the amount of rearward travel $M_R$ to the rearward position R is equal in stroke to the amount of forward travel $M_F$ to the forward position F.

Figure 7:
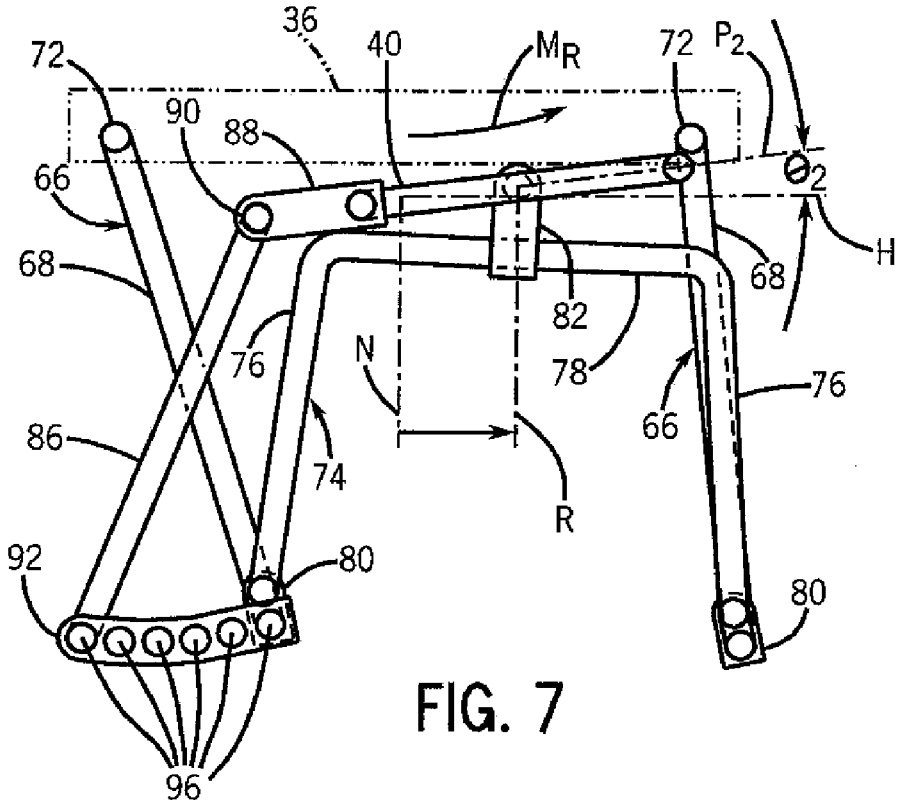
FIG. 7 is a partial side elevation view of the adjustable motion assembly illustrated in FIG. 5 showing the motion in an opposing second direction opposite the first direction.

As the swing arms 66 pivot about their upper joints 72, the angle $\theta_1$ increases relative to the horizontal, thereby changing the orientation of the seat holder 40 relative to the reference plane 26 which indicates that the travel path of the seat holder has a swinging component. In a pure swinging motion, any given point on the seat holder 40 would follow an arcuate path defined by a radius extending from a stationary pivot location. However, as illustrated in FIGS. 5-7, the various locations on the seat holder move in an arcuate path defined by a radius extending from a translating pivot location, thus indicating that the travel path of the seat holder 40 further includes a gliding component. Accordingly, as the seat holder (and corresponding child seat 46) reciprocally oscillates during operation, the seated child will travel along a soothing rocking path that has both gliding and swinging motion components.

It should be appreciated that the lower end of the arm 86 could alternatively be connected to different connector locations on the bracket 92, and that as the selected connection is increasingly rearward from the front connection illustrated in FIG. 7, the arm 86 will decreasingly bias the front end of the seat holder 40 vertically, thereby reducing the angles $\theta_1$ and $\theta_2$ during operation. The reduction of angles $\theta_1$ and $\theta_2$ indicate that the gliding component of the seat holder motion has increased while the swinging component of the seat holder motion has decreased. Accordingly, the child motion device 20 is capable of imparting a motion path onto the seat assembly 30 having an adjustable swinging component and an adjustable gliding component.

Figure 8:
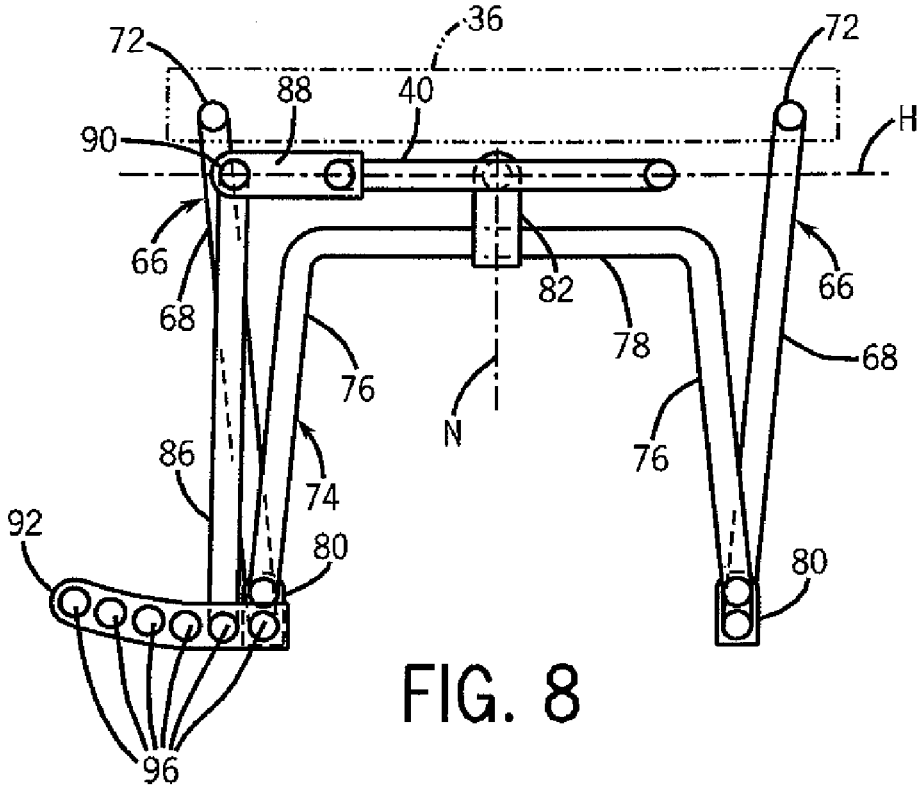
FIG. 8 is a partial side elevation view of the child motion device illustrated in FIG. 1 including, wherein the adjustable motion assembly is configured to impart a motion having a pure gliding component in accordance with another aspect of the present invention.
Figure 9:
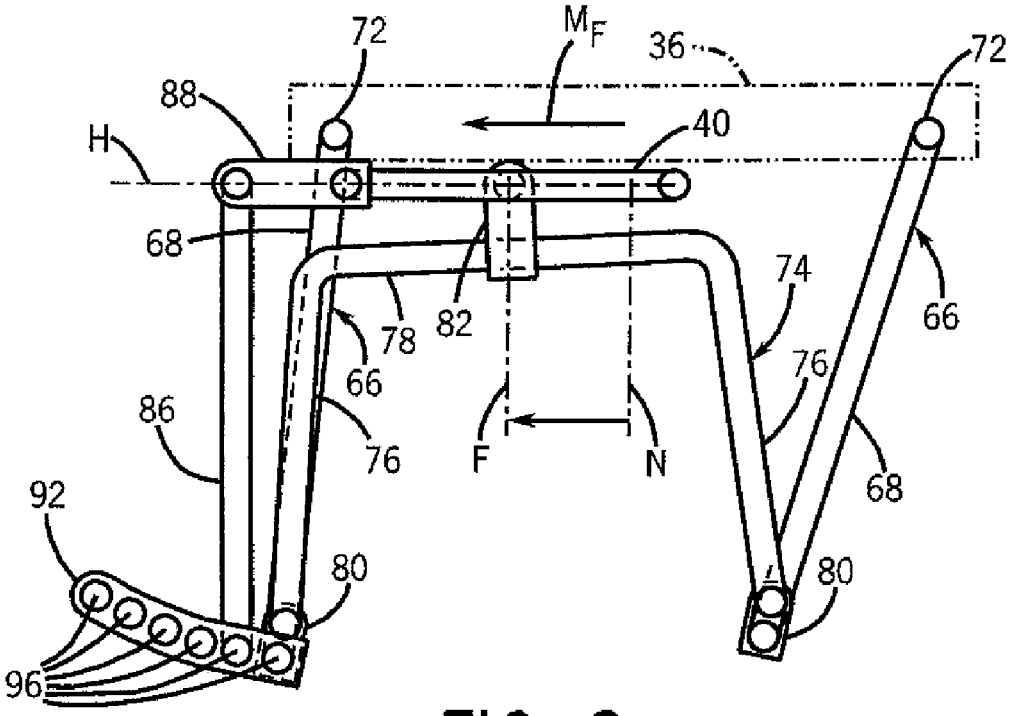
FIG. 9 is a partial side elevation view of the adjustable motion assembly illustrated in FIG. 8 showing the motion in a first direction.
Figure 10:
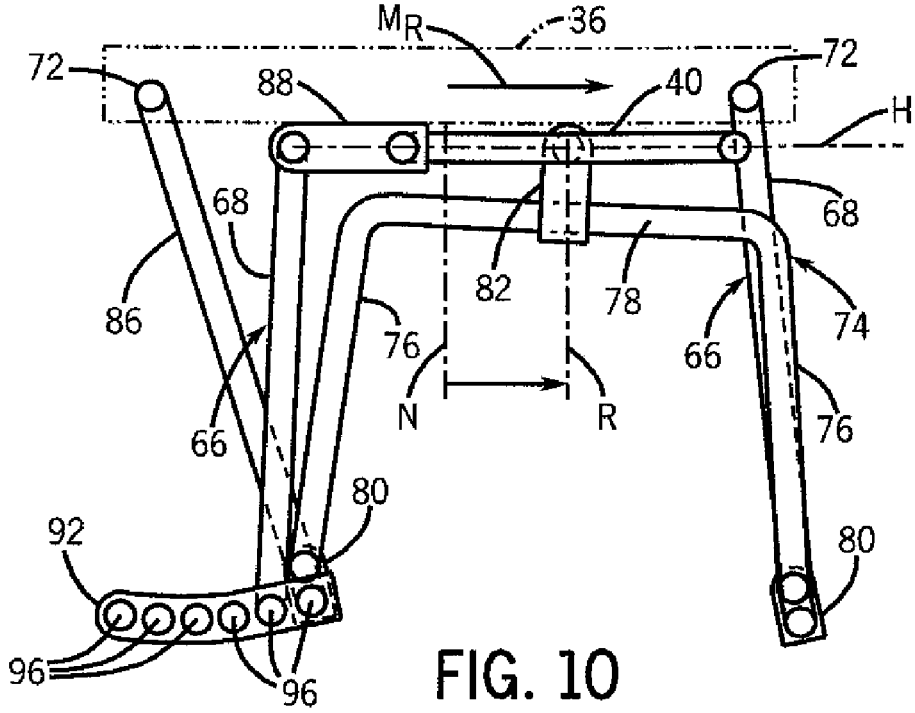
FIG. 10 is a partial side elevation view of the adjustable motion assembly illustrated in FIG. 8 showing the motion in a second direction opposite the first direction.

Referring now to FIGS. 8-10, the lower end of the adjustable arm 86 is connected to the rearward most connection location 96, and maintains the seat holder 40 in a horizontal orientation parallel to the reference plane when the motion assembly 28 is in its neutral position N. As the swing arms 66 are driven clockwise about their upper pivot joints 72, the adjustable arm 86 maintains the seat holder 40 in its horizontal orientation as the seat holder 40 moves horizontally and vertically to its forward position F. As the swing arms 66 rotate about their pivot joints 72 in a counterclockwise direction, the seat holder 40 travels to a rearward position R while maintaining its horizontal orientation. Because the seat holder 40 maintains its orientation (e.g., relative to the reference plane 26), the seat holder follows a travel path having a gliding component but no swinging component. Accordingly, the adjustable motion assembly 28 is capable of reciprocally driving the seat holder forward and backward along a travel path that includes a gliding component and no swinging component.

Figure 11:
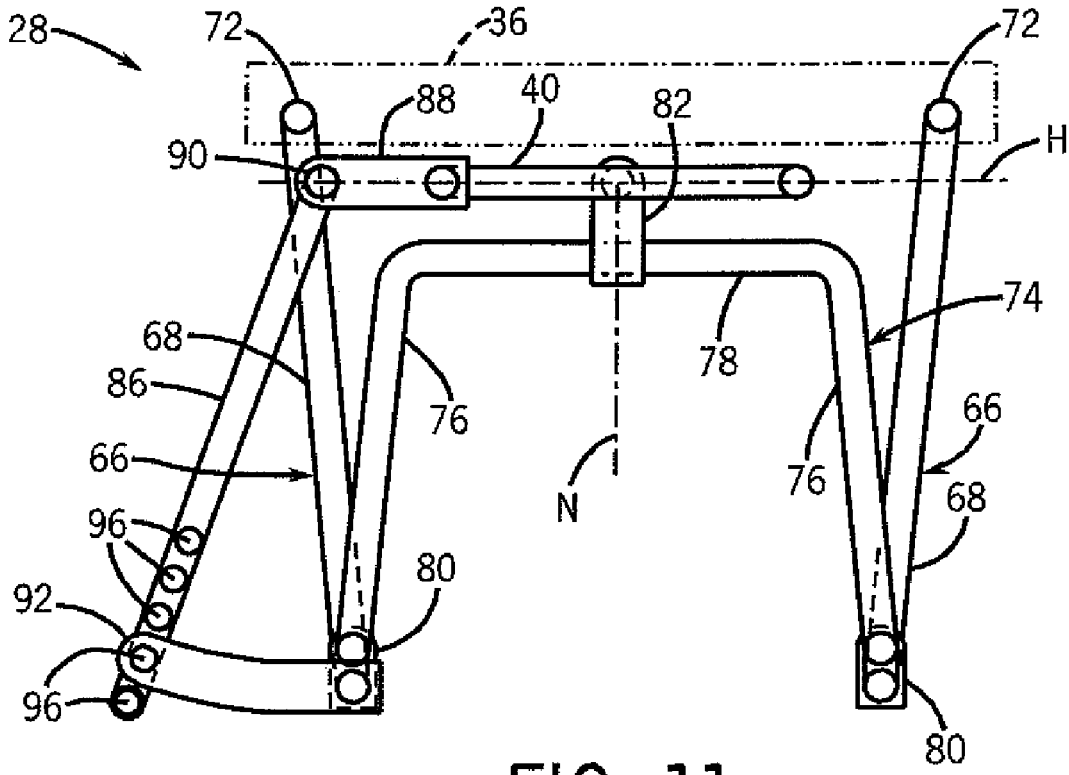
FIG. 11 is a partial side elevation view of an adjustable motion assembly constructed in accordance with an alternative embodiment.

It should be appreciated that while various structural embodiments have been described in accordance with certain aspects of the present invention, it should be understood that the present invention is not limited to the illustrated configurations, and that alternative configurations are contemplated that provide an adjustable motion assembly capable of moving a seat assembly along a travel path having a sliding motion component and a gliding motion component. One such alternative embodiment is illustrated in FIG. 11. Specifically, the connection locations 96 are vertically spaced along the lower end of the adjustable arm 86 such that the arm 86 can be connected to the bracket 92 in a selected one of any one of the connection locations 96. The adjustable motion assembly 28 can thus be configured in any one of several vertically offset positions that in one mode can cause the travel path of the seat assembly 30 to have a gliding component and a sliding component. Depending on the selected connection location 96, the gliding component can increase or decrease, and the sliding component can decrease or increase respectively. In one configuration, the arm 86 can be connected at a select one of the connection locations 96 that provides a travel path onto the seat assembly 30 that has a gliding component only in the manner described above. The connection location that causes a pure gliding motion can have a visible marking and/or a notch that provides visible and/or tactile feedback to the user selecting the connection location.

Furthermore, as described above, in all modes of operation, one or more spring members can be disposed in the seat assembly 30, thus including a bouncer feature to the device 20. In the illustrated example, the spring members 48 are captured between the seat holder 40 and the lower surface of the child seat 46. The spring members 48 can have a spring constant that causes the child seat 46 to bounce due to the gravitational and inertial forces acting on the child seat assembly 30 due to the motion of the swing arms 66. Alternatively, a child's motion or a parent's touch can impart a mechanical bouncing motion.

It should be appreciated that the child motion device 20 is constructed according to one aspect of the invention to simulate or mimic various movements that might be employed by a mother or father as they hold a child in their arms. An adult holding a child will often alternate raising and lowering their shoulders to simulate a rocking movement. Other times, the adult may simply sway the child back and forth by laterally moving their elbows from side to side while holding the child to simulate a gliding movement. Sometimes an adult may employ a combination of such movements to simulate a movement having both rocking and gliding components, and may simultaneously gently bounce the baby up and down in sequential vertical movements.

In any instance, an adult can easily alter the position of the child held in their arms. Sometimes an adult may hold a child in a somewhat seated position with the child facing away from their chest. In another example, the child may be held in a position looking directly at the adult. In another example, the child may be held with their legs to one side and head to another side and rocked by the adult. The disclosed child motion devices can simulate any or all of these various proven, natural, calming and soothing movements.

Additional play or entertainment features can also be employed in the disclosed devices. Motion speed options, music and sound options, and other entertainment features can be configured as part of the device. These features can be electronically linked to occur as part of optional, selectable program settings or use modes. For example, a "soothing" setting could be programmed to pre-select music or background sound to accompany a use mode or other product features to create desired characteristics for that setting. Other optional settings can have their own pre-programmed or selectable features as well. Additionally, different play features associated with the devices can be employed in different ways, depending upon the selected child seat orientation. For example, with the seat facing the axis of rotation R of the support arm, the child's field of view will essentially always be the spine and its housing. An entertainment device, a toy, a video screen such as an LCD screen, or the like can be mounted on or part of the housing to entertain the child as they move. Toys or other play features can also be provided as part of or attachable to the child seat 36, if desired.

The details of the various child motion device examples disclosed herein can vary considerably and yet fall within the spirit and scope of the present invention. The construction and materials used to form the frame assembly parts, the spine parts, and the added features can vary from plastics, to steel tubing, to other suitable materials and part structures. The drive system components can also vary, as can the features employed in the drive system to create desired motions and functions for the disclosed devices. The housing can have a top cap that rotates with and/or is integrally a part of the swing arm. Alternatively, the housing can provide a platform on the top or on a side of the spine such that the driven end of the support arm is supported by the platform and rotates relative to the platform.

The child seat bottom or base can be configured so that it engages with the seat holder in any suitable manner. As disclosed herein, vertical or vertically angled notches can be provided in the seat base. The size of the seat holder tubes or other materials can be configured to slip into the notches to engage with the seat. Gravity and the weight of a child can be enough to retain the seat in the holder. However, positive latching structures can be employed if desired. The seat can also be configured to include common features such as a harness system, carrying handles, a pivotable tray, and a hard plastic shell. The base of the seat can have a rocking, bouncing, or stationary support structure configuration and the seat can employ a pad, cover, or other suitable soft goods. As noted above, the seat holder can be configured to hold other devices such as a bassinet or other child supporting device.

The seat can also be configured to mate within a platform or system of related products. In other words, the seat could be removable from one of the disclosed motion devices and readily placed in a different product that is configured to accept the seat. Such related products can be, for example, a cradle swing frame, a standard pendulum-type swing frame, a bouncer frame, a stroller, a car seat base, or an entertainment platform. In this way, the product system can be useful as a soothing or calming device when a child is young then be transformed for use as an entertainment device. In another example, the child seat could be fixed to the support arm and not removable.

Also, though not shown in detail herein, each foldable joint of the frame assemblies can have positive locking or detent mechanisms to retain or lock the devices in either or both the in-use and the folded configurations. The joints can be gear-type joints, a combination of spring biased locking pins, pivot joints, and apertures, or other latching mechanisms. Alternatively, the devices disclosed herein need not be foldable at all, if desired, but instead can be constructed so that they can not be collapsed without disassembly of the components. Quick disconnect joints can be employed so that the device can be easily broken down for transport or storage. The seat holder can even be separately detachable and replaceable with other seat holders of different configuration to accommodate different child supporting devices, if desired.

The invention has been described in connection with what are presently considered to be the most practical and preferred embodiments. However, the present invention has been presented by way of illustration and is not intended to be limited to the disclosed embodiments. Accordingly, those skilled in the art will realize that the invention is intended to encompass all modifications and alternative arrangements included within the spirit and scope of the invention, as set forth by the appended claims.

What is claimed is:

1. A child motion device comprising:

a frame configured to be supported by a support surface;

an adjustable motion assembly supported by the frame at a location spaced from the support surface, the adjustable motion assembly having a plurality of elongate pivoting components including a crossbar extending between a pair of uprights; and a child seat holder pivotally supported by the adjustable motion assembly and spaced above the crossbar, wherein the adjustable motion assembly is adapted to impart a gliding motion travel path and a swinging motion travel path to the child seat holder, and wherein the adjustable motion assembly can be adjusted by altering the relative positioning of one of the elongate pivoting components to selectively increase or decrease the gliding motion and swinging motion of the child seat holder travel path.

2. The child motion device as recited in claim 1, wherein the child seat holder travel path comprises a pure gliding motion.

3. The child motion device as recited in claim 1, wherein the adjustable motion assembly is reciprocally driven through an arc segment.

4. The child motion device as recited in claim 1, wherein the plurality of elongate pivoting components of the adjustable motion assembly comprises a pair of swing arms having opposing first and second ends, wherein the swing arms pivot about their first ends and support the child seat holder at their second ends.

5. The child motion device as recited in claim 4, wherein the crossbar extends between the second ends of the pair of uprights.

6. The child motion device as recited in claim 5, further comprising at least one seat holder support extending from the crossbars and the seat holder is pivotally connected to the at least one seat holder support.

7. The child motion device as recited in claim 6, wherein the plurality of elongate pivoting components of the adjustable motion assembly further comprises an adjustable arm connected between the seat holder and the crossbar at a selected one of a plurality of connection locations, and wherein the selected connection location at least partially determines the child seat holder travel path.

8. The child motion device as recited in claim 1, further comprising a drive assembly connected to the adjustable motion assembly.

9. The child motion device as recited in claim 8, wherein the drive assembly is configured to impart a motion to the adjustable motion assembly that in turn moves the child seat holder along the child seat holder travel path.

10. The child motion device as recited in claim 1, wherein the child seat holder is configured to support a child seat.

11. The child motion device as recited in claim 10, wherein the child seat holder is configured to impart a bouncing motion onto the supported child seat.

12. The child motion device as recited in claim 1, wherein the plurality of elongate pivoting components of the adjustable motion assembly includes an adjustable arm connected at one of a plurality of locations capable of at least partially determining the degree of the swinging motion and the gliding motion imparted to the child seat holder travel path.

13. The child motion device as recited in claim 12, wherein the adjustable arm can be connected at one of the plurality of locations that imparts only gliding motion.

14. A child motion device comprising:

a frame configured to be supported by a support surface;

an adjustable motion assembly pivotally supported by the frame at a location spaced from the support surface and having multiple elongate components adapted to pivot relative to one another;

a child seat assembly supported by the adjustable motion assembly; and a drive assembly configured to drive the adjustable motion assembly to impart a gliding and a swinging motion to the child seat assembly along a travel path, wherein the child seat assembly comprises a child seat with a seat facing orientation that is adjustable about a substantially vertical axis, and wherein the adjustable motion assembly can be adjusted by altering the relative positioning of the multiple elongate components to selectively increase or decrease a degree of the gliding motion and the swinging motion imparted to the child seat assembly travel path.

15. The child motion device as recited in claim 14, wherein the child seat assembly is supported such that the travel path further comprises a bouncing component.

16. The child motion device as recited in claim 14, wherein the multiple elongate components of the adjustable motion assembly comprise an adjustable arm that can be connected to the frame at a select one of a plurality of connection locations that at least partially determine the degree of gliding motion and swinging motion.

17. The child motion device as recited in claim 16, further comprising a bracket disposed between the frame and the adjustable arm, wherein the plurality of connection locations is disposed on the bracket, and wherein the adjustable arm is connected to the bracket at the select one of the connection locations.

18. The child motion device as recited in claim 16, further comprising a bracket disposed between the frame and the adjustable arm, wherein the plurality of connection locations is disposed along the adjustable arm, and wherein the bracket is connected to the adjustable arm at the select one of the connection locations.

19. The child motion device as recited in claim 14, wherein the drive assembly drives the adjustable motion assembly in a partial arc segment that in turn drives the child seat assembly along the travel path.

20. A child motion device comprising:

a frame configured to be supported by a support surface;

an adjustable motion assembly having an upper end pivotally supported by the frame at a location spaced from the support surface and having multiple elongate components adapted to pivot relative to one another and having a lower end;

a child seat assembly pivotally supported by the adjustable motion assembly adjacent the upper end; and a drive assembly configured to drive the adjustable motion assembly to impart a gliding and a swinging motion to the child seat assembly along a travel path, wherein the adjustable motion assembly can be adjusted by altering the relative positioning of the multiple elongate components to selectively increase or decrease a degree of the gliding motion and the swinging motion imparted to the child seat assembly travel path.

* * * * *